US009022245B2

(12) United States Patent
Jordan et al.

(10) Patent No.: US 9,022,245 B2
(45) **Date of Patent: *May 5, 2015**

(54) UNIVERSAL SUPPORT ARRANGEMENT FOR SEMI-MEMBRANE TANK WALLS

(71) Applicant: National Steel and Shipbuilding Company, San Diego, CA (US)

(72) Inventors: David L. Jordan, Pawcatuck, CT (US); William E. Michaud, Groton, CT (US)

(73) Assignee: National Steel and Shipbuilding Company, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/847,858

(22) Filed: Mar. 20, 2013

(65) Prior Publication Data

US 2013/0240541 A1 Sep. 19, 2013

Related U.S. Application Data

(63) Continuation of application No. 13/032,813, filed on Feb. 23, 2011, now Pat. No. 8,430,263, and a continuation of application No. 11/723,039, filed on Mar. 16, 2007, now Pat. No. 7,896,188.

(51) Int. Cl.
*F17C 1/00* (2006.01)
*B65D 25/00* (2006.01)
(Continued)

(52) U.S. Cl.
CPC ..... *B65D 25/00* (2013.01); *F17C 3/022* (2013.01); *F17C 3/027* (2013.01);
(Continued)

(58) Field of Classification Search
CPC .. F17C 3/022; F17C 3/0113; F17C 2270/027; F17C 2201/0157; F17C 2201/052; F17C 2203/015; F17C 2203/0304; F17C 2203/0358; F17C 2203/0604; F17C 2203/0619; F17C 2203/0629; F17C 2203/0643; F17C 2203/0646; F17C 2209/228
USPC ..... 220/560, 565, 581, 586, 592, 646, 647; 114/74 T, 74 A; 137/376
See application file for complete search history.

(56) References Cited

U.S. PATENT DOCUMENTS 2,911,125 A 11/1959 Dosker
3,021,027 A 2/1962 Claxton
(Continued)

FOREIGN PATENT DOCUMENTS

JP 4927012 A 3/1974
JP 53140617 B1 12/1978
(Continued)

OTHER PUBLICATIONS

Transportation of Liquefied Natural Gas, Sep. 1977.
(Continued)

*Primary Examiner* — Robert J Hicks
*Assistant Examiner* — Kareen Rush
(74) *Attorney, Agent, or Firm* — Ingrassia, Fisher & Lorenz, P.C.

(57) ABSTRACT

Embodiments of the invention relate to support arrangements for semi-membrane tank walls and, more particularly, to a universal support assembly for tanks that experience thermal expansion and contraction. One embodiment of the invention may include a tank assembly having at least one tank wall, a support structure at least partially adjacent to the wall, and a link member coupling the tank to the support structure. The link member may be configured to accommodate relative movement between the tank and the support structure through rotation. The link member may be coupled to the tank wall by a ball and socket joint and coupled to the support structure with another ball and socket joint, allowing substantially unlimited in-plane movement of the tank wall relative to the support structure.

19 Claims, 10 Drawing Sheets

(51) Int. Cl.
*F17C 3/02* (2006.01)
*B65D 19/00* (2006.01)

(52) U.S. Cl.
CPC .. *F17C 2201/0157* (2013.01); *F17C 2201/052* (2013.01); *F17C 2203/015* (2013.01); *F17C 2203/0304* (2013.01); *F17C 2203/0358* (2013.01); *F17C 2203/0604* (2013.01); *F17C 2203/0619* (2013.01); *F17C 2203/0629* (2013.01); *F17C 2203/0643* (2013.01); *F17C 2203/0646* (2013.01); *F17C 2209/228* (2013.01); *F17C 2209/232* (2013.01); *F17C 2221/033* (2013.01); *F17C 2223/0153* (2013.01); *F17C 2223/0161* (2013.01); *F17C 2223/033* (2013.01); *F17C 2270/0107* (2013.01); *F17C 2270/0113* (2013.01); *F17C 2270/0134* (2013.01); *B65D 19/00* (2013.01)

(56) References Cited

U.S. PATENT DOCUMENTS

| | | | | |
|---|---|---|---|---|
| 3,071,094 | A | | 1/1963 | Leroux |
| 3,273,740 | A | | 9/1966 | Herrenschmidt |
| 3,380,611 | A | | 4/1968 | Brougham et al. |
| 3,423,115 | A | | 1/1969 | Korecky |
| 3,425,583 | A | | 2/1969 | Bridges |
| 3,509,848 | A | | 5/1970 | Salmon |
| 3,547,302 | A | | 12/1970 | Jackson et al. |
| 3,704,903 | A | | 12/1972 | Ito |
| 3,759,555 | A | | 9/1973 | Ito |
| 3,767,150 | A | | 10/1973 | Tabata |
| 3,814,361 | A | | 6/1974 | Gabron et al. |
| 3,841,253 | A | | 10/1974 | Kircik et al. |
| 3,849,009 | A | | 11/1974 | Bourdon |
| 3,856,422 | A | | 12/1974 | Trefry |
| 3,858,907 | A | | 1/1975 | Van Raden |
| 3,861,021 | A | | 1/1975 | Yamamoto |
| 3,899,988 | A | | 8/1975 | Menendez |
| 3,908,574 | A | | 9/1975 | Miller et al. |
| 3,937,353 | A | | 2/1976 | Becker et al. |
| 3,941,272 | A | | 3/1976 | McLaughlin |
| 3,968,764 | A | | 7/1976 | Kvamsdal et al. |
| 3,987,925 | A | | 10/1976 | Sattelberg |
| 4,013,030 | A | | 3/1977 | Stafford |
| 4,173,936 | A | | 11/1979 | Secord et al. |
| 4,181,235 | A | | 1/1980 | Baysinger |
| 4,184,609 | A | * | 1/1980 | Vorreiter ..... 220/560.1 |
| 4,207,827 | A | | 6/1980 | Gondouin |
| 4,223,797 | A | | 9/1980 | Skakunov |
| 4,225,054 | A | | 9/1980 | Jean |
| 4,640,328 | A | | 2/1987 | Arney |
| 4,672,906 | A | | 6/1987 | Asai |
| 4,848,103 | A | * | 7/1989 | Pelc et al. ..... 62/51.1 |
| 5,099,779 | A | | 3/1992 | Kawaichi et al. |
| 5,263,603 | A | | 11/1993 | McBride |
| 5,338,383 | A | | 8/1994 | Polackowyj |
| 5,355,819 | A | | 10/1994 | Hsia et al. |
| 5,363,787 | A | | 11/1994 | Konopasek et al. |
| 5,531,178 | A | | 7/1996 | Abe et al. |
| 5,727,492 | A | | 3/1998 | Cuneo et al. |
| 5,758,456 | A | | 6/1998 | Case |
| 6,619,502 | B2 | | 9/2003 | Walther et al. |
| 6,626,319 | B2 | | 9/2003 | Miller et al. |
| 6,971,537 | B2 | | 12/2005 | Enright, Jr. |
| 7,111,653 | B2 | * | 9/2006 | Cnossen et al. ..... 141/351 |
| 7,111,750 | B2 | | 9/2006 | Gulati et al. |
| 7,469,650 | B2 | | 12/2008 | Jordan et al. |
| 2003/0057214 | A1 | | 3/2003 | Miller et al. |
| 2003/0066834 | A1 | | 4/2003 | Enright |
| 2004/0188446 | A1 | | 9/2004 | Gulati et al. |
| 2005/0139595 | A1 | | 6/2005 | Pepin-Lehalleur et al. |
| 2013/0180993 | A1 | * | 7/2013 | Pichette ..... 220/530 |

FOREIGN PATENT DOCUMENTS

| | | | |
|---|---|---|---|
| JP | 9226698 | A | 9/1997 |
| WO | 2005093315 | B2 | 10/2005 |

OTHER PUBLICATIONS

Intellectual Property Office of the Philippines Bureau of Patents; Office Action for Patent Application No. 1/2009/501755 dated Dec. 3, 2012.

Notification of Second Office Action; Chinese Patent Application No. 200880014712.1 dated Nov. 29, 2012.

Japan Patent Office, Office Action in Japanese Patent Application No. 2009-553572, mailed May 7, 2013.

China Patent & Trademark Office, Office Action dated May 27, 2013 for Chinese Patent Application No. 200880014712.1.

* cited by examiner

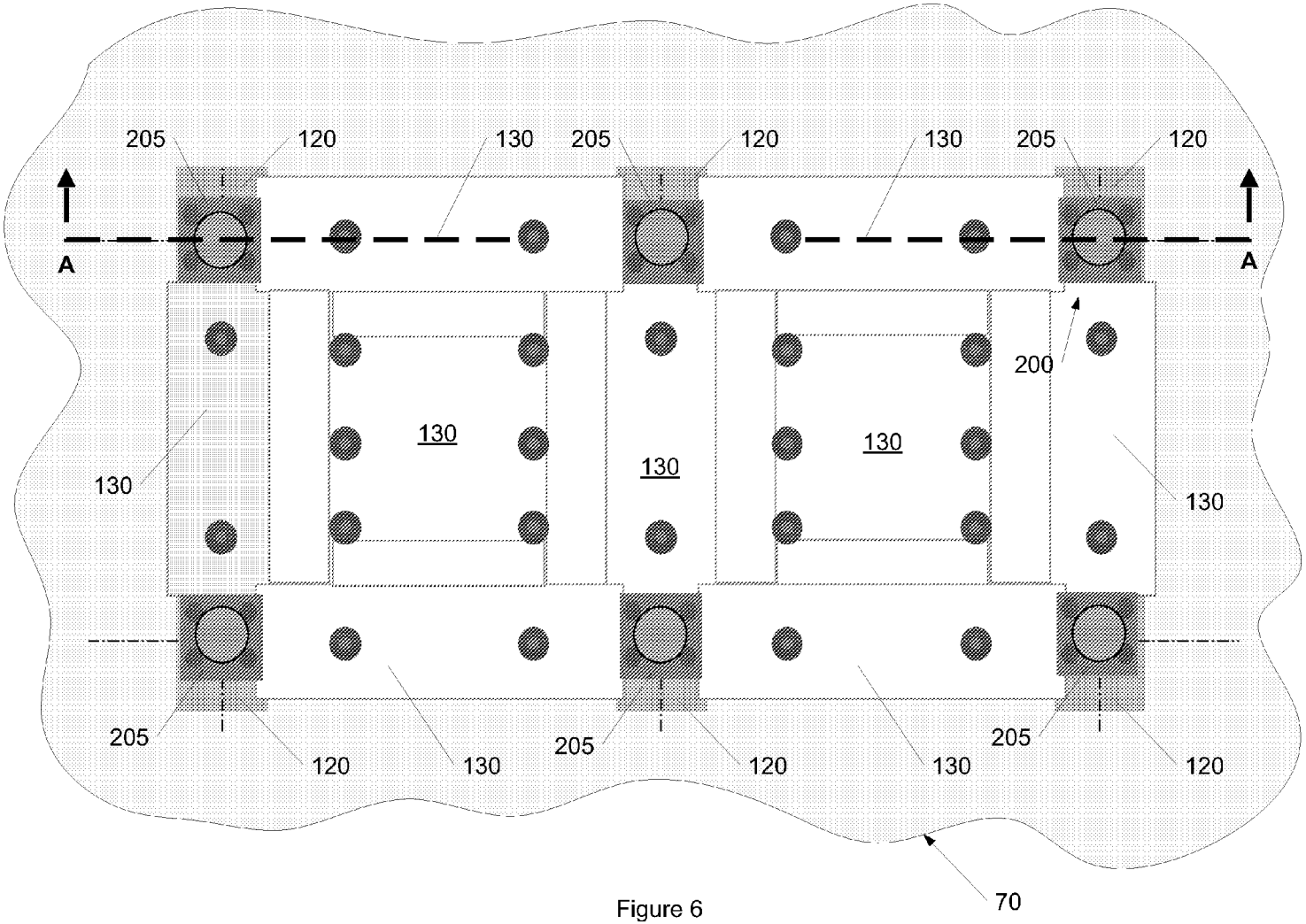
A
A
120
205
130
200
130
130
130

UNIVERSAL SUPPORT ARRANGEMENT FOR SEMI-MEMBRANE TANK WALLS

CROSS-REFERENCE TO RELATED APPLICATION(S)

This application is a continuation of U.S. patent application Ser. No. 13/032,813, filed Feb. 23, 2011, which is a continuation of U.S. patent application Ser. No. 11/723,039, filed on Mar. 16, 2007, and issued on Mar. 1, 2011 as U.S. Pat. No. 7,896,188.

FIELD OF THE INVENTION

Embodiments of the present invention relate to support arrangements for semi-membrane tank walls and, more particularly, to a universal support assembly for tanks that experience thermal expansion and contraction.

BACKGROUND OF THE INVENTION

U.S. Pat. No. 5,727,492 discloses an example of a semi-membrane tank capable of holding liquefied gases such as liquefied natural gas ("LNG"). Semi-membrane tanks for this purpose, however, lack sufficient wall strength and rigidity to be self-supporting and use a supporting structure to transfer load from the semi-membrane walls to surrounding structure. The supporting structure typically includes a grid of beams connected to the semi-membrane walls and connected to an arrangement of support assemblies connecting the grid of beams to a surrounding structure. When a semi-membrane tank is installed in a ship or other containment structure, the structure of the ship may serve as the surrounding structure connecting to the support assemblies. Due to the low temperatures required to transport or store liquefied gases, insulating material or support blocks with low thermal conductivity are typically used to thermally isolate the semi-membrane tank from the surrounding structure.

The temperatures experienced by a semi-membrane tank fluctuate dramatically between ambient temperature and the very low temperatures of liquefied gases, such as −161 degrees Celsius for LNG. Depending on the coefficient of thermal expansion ("CTE") of the semi-membrane tank material, this temperature fluctuation results in thermal contractions when the semi-membrane tank cools. If the semi-membrane tank is rigidly attached to the surrounding structure, the thermal contractions and expansions during temperature fluctuations of the tank may induce unacceptable stresses on the surrounding structure. To alleviate this condition, the support assemblies connecting the semi-membrane tank and the surrounding structure may be configured to allow for relative movement between the semi-membrane tank and the surrounding structure.

U.S. Pat. No. 6,971,537 shows a support arrangement for a semi-membrane LNG tank having a support assembly allowing relative motion between the semi-membrane tank wall and the surrounding structure in two orthogonal directions. More particularly, the support assemblies include a complicated set of grooves and brackets that receive a connecting element in a linear sliding motion. The support arrangement provides for linear sliding motion in a groove in a first direction and linear sliding motion in a bracket in another direction. Although the horizontal center line of the LNG tank disclosed in the U.S. Pat. No. 6,971,537 may be supported in the vertical direction, the support assemblies disclosed allow the tank to expand and contract in the vertical and horizontal directions using the linear sliding configuration of the support assemblies.

The support assemblies of U.S. Pat. No. 6,971,537 are imbedded in the insulation covering the semi-membrane tank and requires a flexible boot to be installed around each support assembly. The flexible boot requires inspection and maintenance throughout the life of the semi-membrane tank, which can be costly because inspection typically requires the removal and replacement of tank insulation. Additionally, because the support assemblies only slide linearly along orthogonal directions, each row of support assemblies need to be installed along different radial paths from the center of the tank in order to achieve in-plane unrestricted movement. The configuration of support blocks on the semi-membrane tanks connecting to the support assemblies also complicates the manufacturing of and installation of the complex supporting assemblies. Because the support assemblies slide relative to the supporting blocks, an insulation gap around the support block is necessary to allow for free movement of the support assemblies during thermal expansion and contraction. This may function to increase heat loss to the liquefied gas containment system and increase the boil-off rate. Additionally since the support blocks are required to transfer the thermal and dynamic loads from the tank to the surrounding structure, they may become quite large complicating handling and installation and increasing installation/erection costs.

SUMMARY OF THE INVENTION

Embodiments of the invention include a tank assembly having at least one tank wall, a support structure at least partially adjacent to the wall, and a link member coupling the tank to the support structure. The link member may be configured to accommodate relative movement between at least a portion of the tank and the support structure. The link member may include a first end coupled to the wall and configured to rotationally move relative to the wall and a second end coupled to the support structure and configured to rotationally move relative to the support structure.

Another embodiment of the invention may include a support arrangement for a semi-membrane tank having a first plurality of support members at least partially adjacent to a semi-membrane tank having a first wall and a first plurality of support assemblies coupling the first wall to the first plurality of support members. Each of the first plurality of support assemblies may include a first link member having a first end rotationally coupled to the first wall and a second end rotationally coupled to the first plurality of support members. Each of the first plurality of support assemblies may be configured to accommodate relative movement between at least a portion of the first wall and the first plurality of support members.

Another embodiment of the invention may include an assembly for storing liquefied gas having a semi-membrane tank with a first wall, a plurality of support members at least partially adjacent to the first wall, and a first plurality of support assemblies configured to couple the first wall to the plurality of support members. Each of the first plurality of support assemblies may include a first link member having a first end rotationally coupled to the first wall and a second end rotationally coupled to at least one of the plurality of support members. Each of the first plurality of support assemblies may be configured to accommodate relative rotational movement between at least a portion of the first wall and the first plurality of support members.

Another embodiment of the invention may include a support assembly for a tank wall having a link member with a first end and a second end, a first ball and socket joint coupled to the first end of the link member and configured to couple to a semi-membrane tank wall, and a second ball and socket joint coupled to the second end of the link member and configured to couple to a semi-membrane support structure.

Embodiments of the invention may also include a method of supporting a tank wall by rotationally coupling a tank wall to a supporting structure and accommodating movement of the tank wall relative to the supporting structure.

BRIEF DESCRIPTION OF THE DRAWINGS

FIG. 6 schematically illustrates a plan view of a portion of a wall of a semi-membrane tank in accordance with an embodiment of the invention;

DESCRIPTION OF THE PREFERRED EMBODIMENTS

Embodiments of the invention relate to support assemblies and an arrangement of support assemblies for use with a semi-membrane tank wall capable of holding liquefied gases such as liquefied natural gas ("LNG"). The support arrangement may be configured to allow thermal expansion and contraction of a semi-membrane tank wall upon changes in temperature due to filling or emptying the tank. The support assemblies may be configured to provide a support arrangement for semi-membrane tank walls which permits relative motion of the tank walls with respect to the surrounding support structure while providing thermal insulation between the tank and the surrounding structure.

Figure 1:
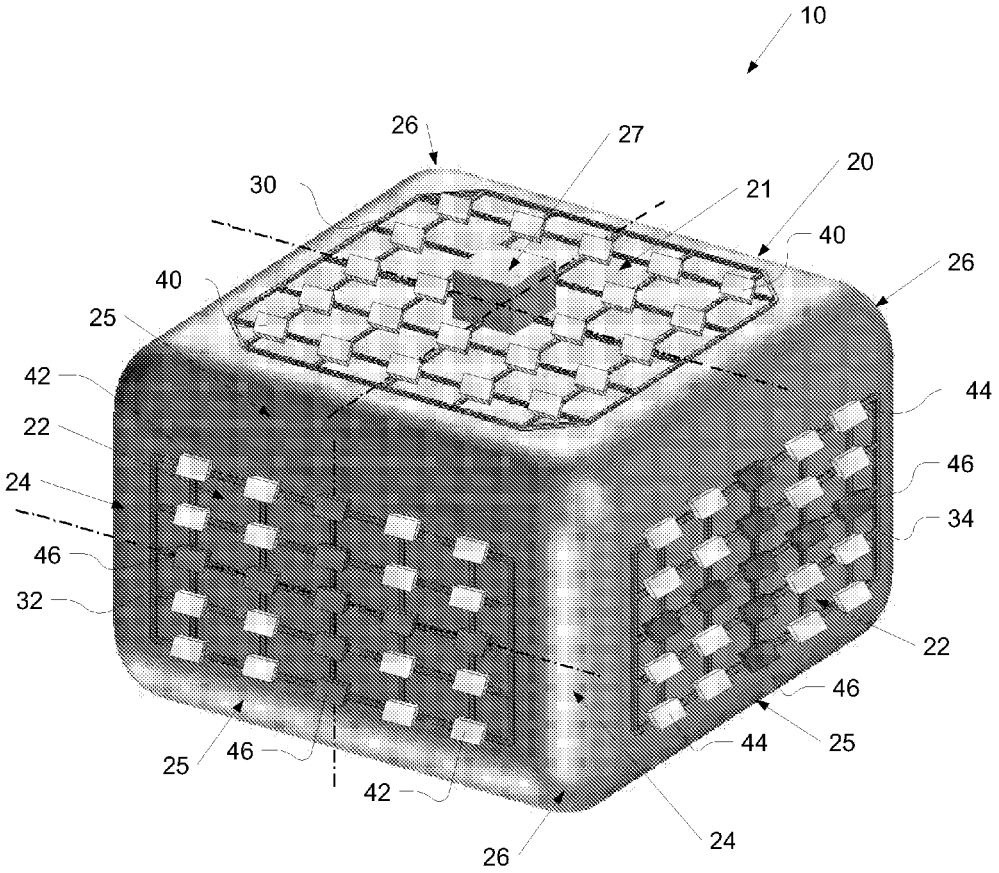
FIG. 1 schematically illustrates a semi-membrane tank and support arrangement in accordance with an embodiment of the invention.

FIG. 1 schematically illustrates an example of a support arrangement 10 for a semi-membrane tank 20 in accordance with an embodiment of the invention. The semi-membrane tank 20 may include a top wall 21, four side walls 22, and a bottom wall 23 (not shown in FIG. 1). The tank 20 may also include a cylindrical vertical corner 24, upper and lower cylindrical horizontal corners 25, and spherical corner caps 26. The tank 20 may be fabricated out of various metals such as, for example, 9% Nickel steel or aluminum (Grade 5083), with the top, side, and bottom walls may be fabricated out of flat panels. The tank may also include a pipe tower 27 positioned either at the center or at the end of the top wall 21 and capable of facilitating the filling and emptying of the tank.

The top wall 21 may include stiffeners 30 arranged in a grid pattern. Likewise, the side walls 22 may include stiffeners 32 arranged in a grid pattern and stiffeners 34 arranged in a grid pattern as illustrated in FIG. 1. The stiffeners 30, 32, and 34 may be formed as "T" members as discussed in greater detail below. The stiffeners 30, 32, and 34 also provide an attachment structure for universal support assemblies 40 on the top wall 21, universal support assemblies 42 on one side wall 22, and universal support assemblies 44 on another side wall 22. The side walls 22 also include anchor support assemblies 46 positioned on each of the horizontal and vertical center lines of the side walls. Although not shown in FIG. 1, each of the side walls 22 include stiffeners and support assemblies.

As discussed in greater detail below, the universal support assemblies 40, 42, and 44 provide relative motion between a surrounding support structure and the tank 20. The support assemblies 46 may be configured as anchor supports that provide in-plane and normal support while allowing relative movement along the centerlines. For example, the support assemblies 46 arranged on the horizontal centerline shown in FIG. 1 may be configured to provide vertical support and support normal to the sidewall 22 while allowing relative movement along the horizontal centerline direction. The combined relative movement of the support assemblies 40, 42, 44, and 46 may be arranged to accommodate the thermal expansion and contraction of the tank 20. It should be understood that the number and arrangement of the stiffeners 30, 32, and 34 and the support assemblies 40, 42, 44, and 46 shown in FIG. 1 may be changed and reconfigured according to the size and shape of the tank 20.

Figure 2A:
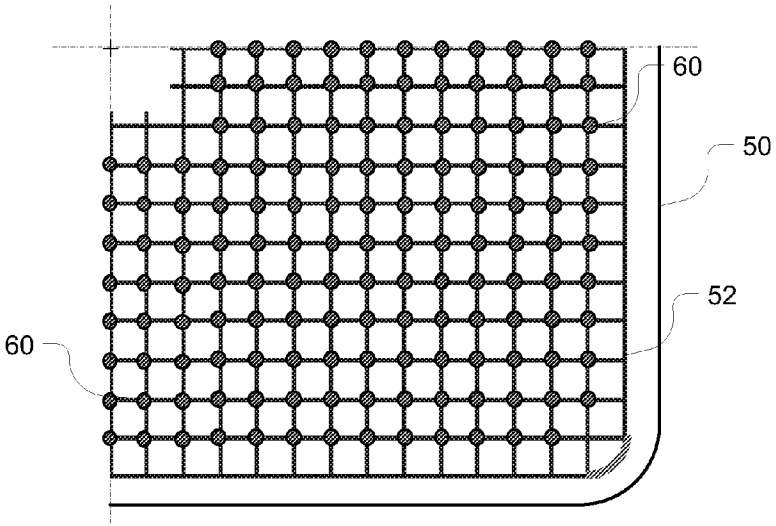
FIGS. 2A, 2B, and 2C schematically illustrate a top view, side view, and end view, respectively, of an example of a support arrangement for one quarter of a semi-membrane tank in accordance with an embodiment of the invention.
Figure 2B:
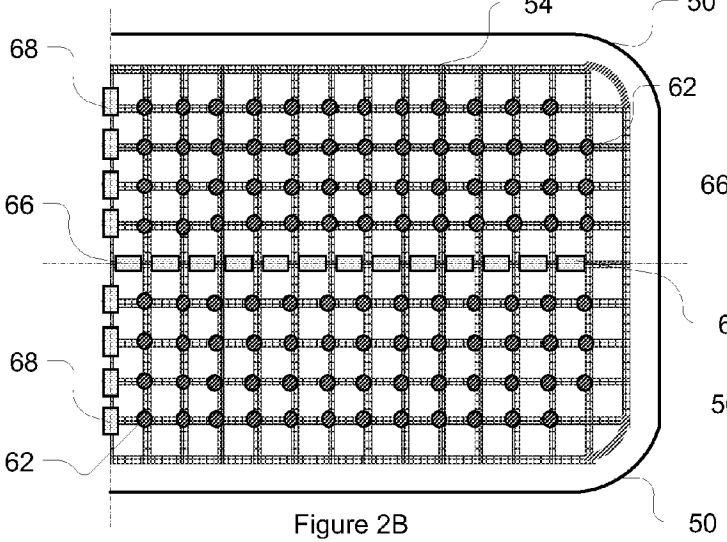
Figure 2C:
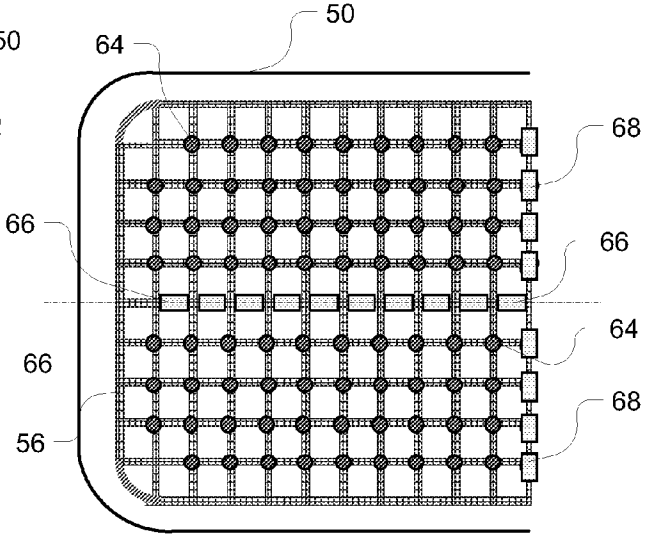

FIGS. 2A, 2B, and 2C schematically illustrate an example of one quarter of a semi-membrane tank 50 and a support arrangement for the quarter of the semi-membrane tank 50 in accordance with an embodiment of the invention. The tank 50 shown in FIGS. 2A, 2B, and 2C is an example of a larger semi-membrane tank than the semi-membrane tank 20 shown in FIG. 1. It should be understood that support arrangements in accordance with embodiments of the invention may be used with different sized and shaped semi-membrane tanks For instance, the semi-membrane tank shown in FIG. 1 is a ¼ scale test tank with a capacity of 225 cubic meters. It should be understood that tank dimensions may be varied to obtain an unlimited range of storage capacities in order to fit within a ship, floating barge, or other such floating or land-based support structure. Additionally, the tank arrangement in FIG. 2 depicts an example of an embodiment of the invention applied to a semi-membrane tank having an internal volume of 40,000 $m^3$ which approximates the capacity of current cargo tank sizes. While FIG. 2 depicts a regular prismatic shape, the semi-membrane tank may be alternatively shaped and sized to suit any ship, barge, or other support structure in order to maximize overall storage volume.

FIG. 2A schematically represents a top plan view of one quarter of the tank 50 and stiffeners 52. FIG. 2B schematically represents a side elevation view of half of one side wall of the tank 50 and the associated stiffeners 54. Likewise, FIG. 2C schematically represents an end elevation view of one half of one side of the of the tank 50 and the associated stiffeners 56.

In FIG. 2A, universal support assemblies 60 (shown representatively as a shaded circle) may be typically arranged at the intersections of the grid pattern for the stiffeners 52, which may be spaced according to the tank loading. Likewise, universal support assemblies 62, shown in FIG. 2B, may be arranged at the intersections of the grid pattern for the stiffeners 54. Finally, universal support assemblies 64, shown in FIG. 2C, may be arranged at the intersections of the grid pattern for the stiffeners 56.

The support assemblies 66 (shown representatively as a shaded square) shown in FIGS. 2B and 2C, may be arranged along the horizontal centerlines of the sidewalls of the tank 50. The support assemblies 68 may be arranged along the vertical centerlines of the sidewalls of the tank 50. The support assemblies 66 and 68 may provide support in-plane and normal to the side walls. For example, the support assemblies 66 arranged on the horizontal center line in FIG. 2B may be configured to provide support in the vertical direction and support in the direction normal to the side wall while allowing relative movement of the tank in the horizontal direction. Likewise, the support assemblies 68 arranged on the vertical center line in FIG. 2B may be configured as known to those of skill in the art to provide support in the horizontal direction and support the normal direction to the side wall while allowing relative movement of the tank in the vertical direction. The same arrangement may be applied to the support assemblies 66 and 68 shown in FIG. 2C. As discussed in greater detail below, the basic structure for the support assemblies may be configured for use with both the support assemblies 60, 62, and 64 and the support assemblies (or anchor blocks) 66 and 68.

Figure 3A:
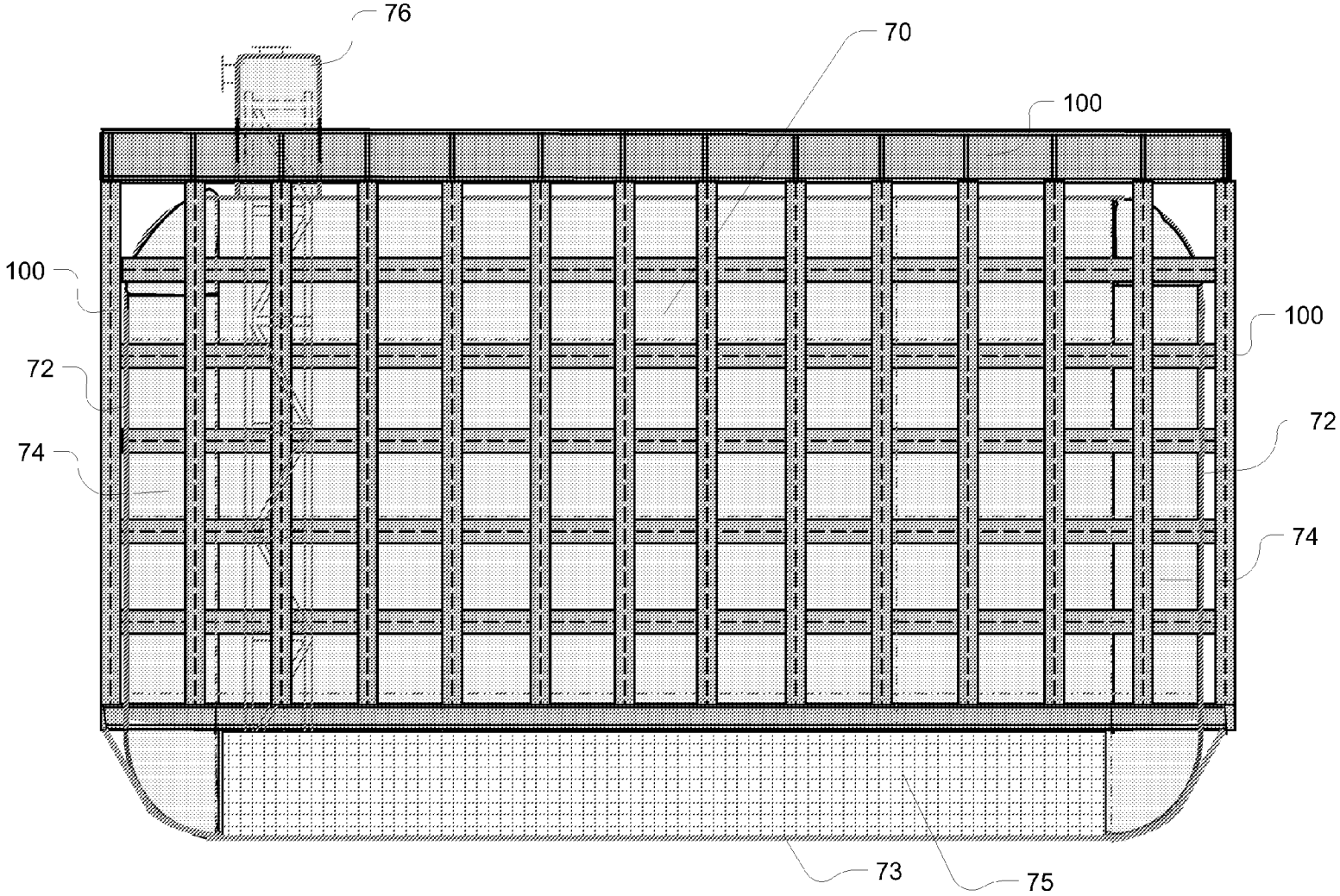
FIG. 3A schematically illustrates an example of a semi-membrane tank and carriage structure in accordance with an embodiment of the invention.

As disclosed in U.S. patent application Ser. No. 11/353,222, filed on Feb. 14, 2006, which is hereby incorporated by reference in its entirely, the semi-membrane tank may be assembled with a support carriage, at least partially surrounding the semi-membrane tank and providing the structure to connect to the support assemblies attached to the top and sides of the semi-membrane tank. Once assembled, the semi-membrane tank and the support carriage may be moved or transported as a single pre-assembled unit. FIG. 3A schematically illustrates an assembled semi-membrane tank 70 surrounded by a surrounding support structure or carriage 100. As shown in FIG. 3A, the tank may have a pipe tower 76 positioned to one side of the semi-membrane tank 70. The tank 70 may also include a sidewall 72, a bottom wall 73, horizontal corner walls 75, and vertical corner walls 74. The semi-membrane tank 70 may be connected to the support structure 100 by an array of the support assemblies and the stiffeners (examples of which are shown in FIGS. 1 and 2). The support assemblies and stiffeners may not be seen in FIG. 3A due to the surround support structure 100. The surrounding support structure or carriage 100 may be constructed from I-beams, T-beams or other such structures. Once assembled, the semi-membrane tank 70 and the supporting structure 100 may be transported to a final installation in a ship, barge or other structure.

Figure 3B:
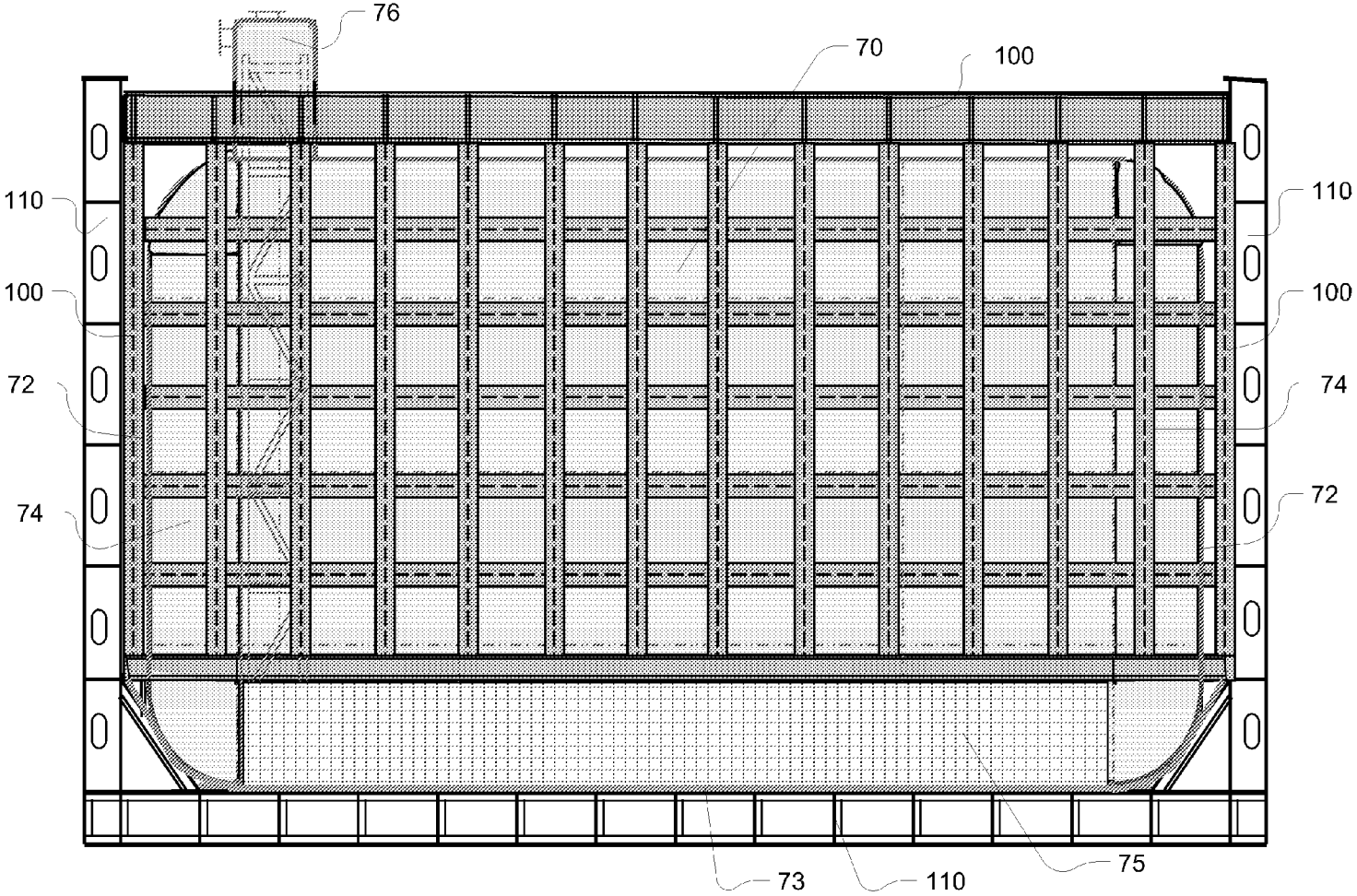
FIG. 3B schematically illustrates an example of the semi-membrane tank and carriage structure shown in FIG. 3A installed in a permanent structure in accordance with an embodiment of the invention.

FIG. 3B schematically illustrates the assembled semi-membrane tank and supporting carriage 100 installed in walls 110 belonging to a ship, barge, or other permanent tank holding structure. The walls 110 may include transverse or longitudinal bulkheads surrounding at least partially surrounding the semi-membrane tank 70 and the support carriage 100. It should be understood that the structure 110 may include other structures capable of holding a semi-membrane tank for purposes of holding or transporting a liquefied gas. For example, the structure 110 may also include a floating barge or land-based structure configured to hold or transport liquefied gases, such as LNG.

Figure 4B:
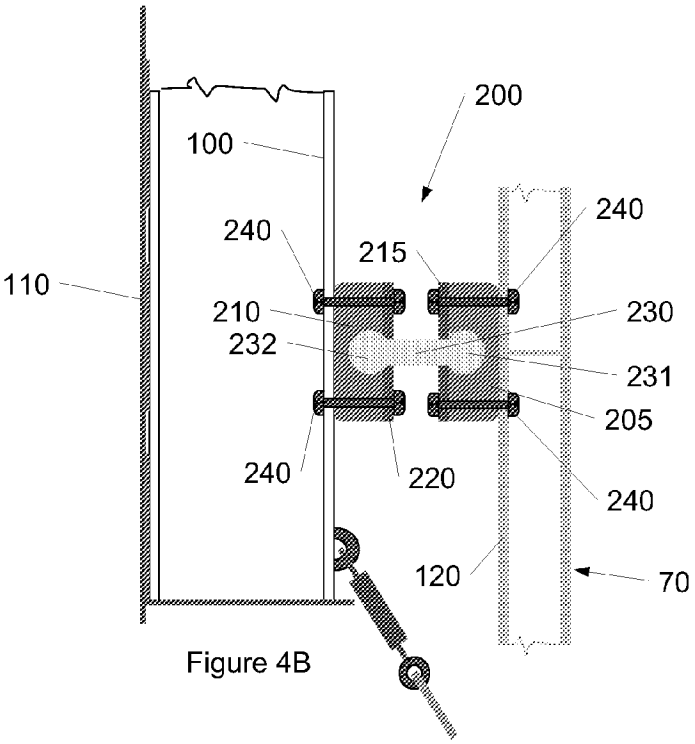
FIG. 4B schematically illustrates an example of a universal support assembly in accordance with embodiments of the invention.
Figure 4A:
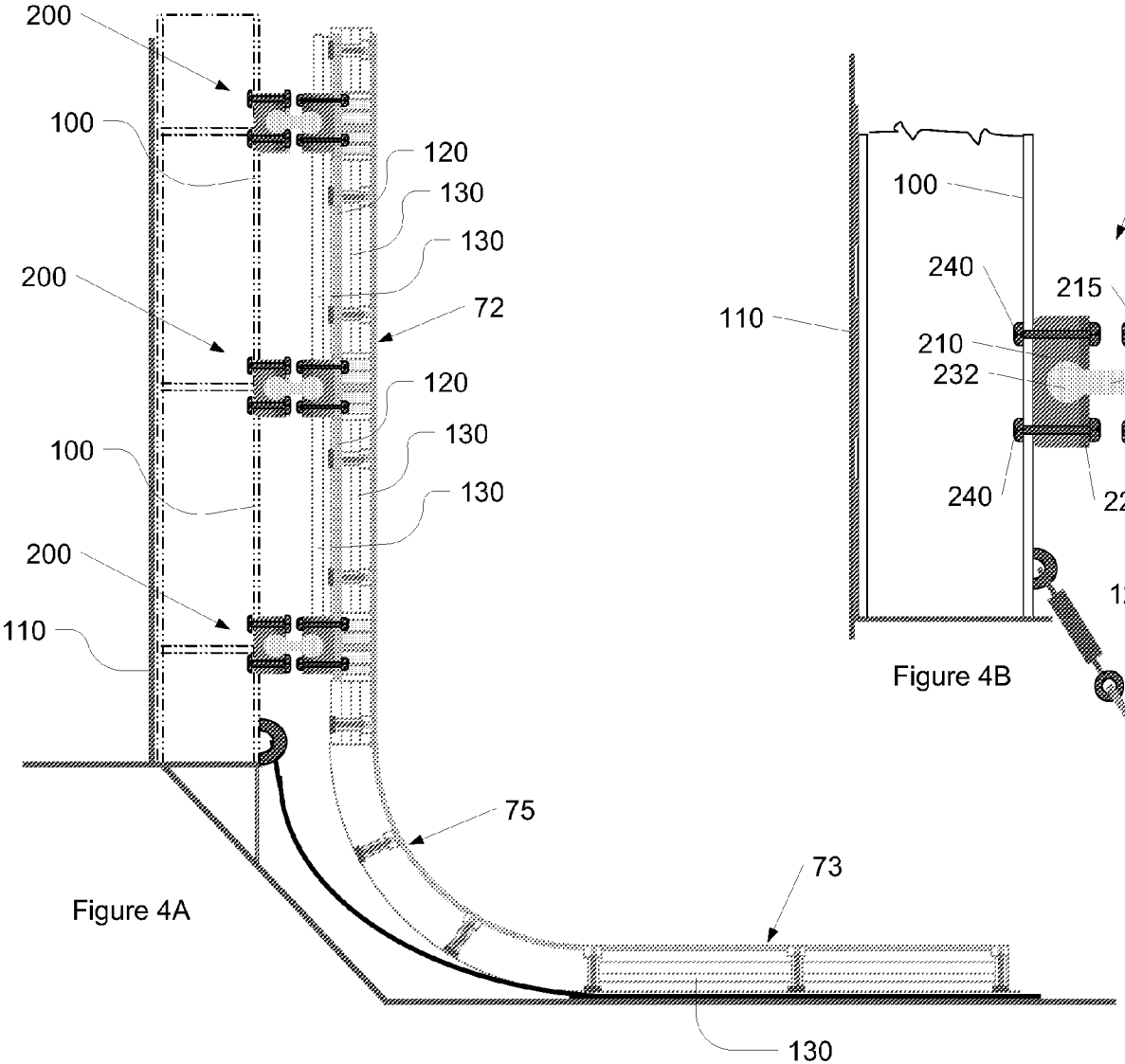
FIG. 4A schematically illustrates a cross section of a portion of the semi-membrane tank and surrounding structure in accordance with an embodiment of the invention.

FIG. 4A schematically illustrates a cross section of a portion of the structures shown in FIG. 3B, including a portion of the semi-membrane tank 70, three universal support assemblies 200, a portion of a surrounding support structure 100, and a portion of a supporting wall 110. The universal support assemblies 200 may represent, as an example, three of the universal support assemblies shown on the side walls in FIGS. 1, 2B, and 2C connecting the tank 20 to the surrounding support structure 100. FIG. 4A shows an array of stiffeners 120 arranged on and attached to the sidewall 72 of the tank 70. As shown in the figure, the universal support assemblies 200 connect the structure 100 to the stiffeners 120, effectively supporting the tank 70. Also shown in FIG. 4A, the tank 70 includes a series of insulation panels 130 installed along the bottom wall 73 and along the side wall 72 of the tank 70. It should be understood that insulation may be provided on every wall of the semi-membrane tank.

FIG. 4B schematically illustrates an example of one of the universal support assemblies shown in FIG. 4A in accordance with embodiments of the invention. Generally, each universal support assembly 200 may include a support block 205 attached to the stiffeners 120 of the tank 70 using fasteners 240. The assembly may include another support block 210 attached to the surrounding support structure 100 using fasteners 240. Each of the support blocks 205 and 210 may include a circular or partially spherical opening machined or formed into the block to receive a link member 230. The link member 230 may include spherical ball ends 231 and 232 configured to fit into the openings in the blocks 205 and 210. The ball end 231 may be held in the block 205 using a keeper or retainer plate 215. Likewise, the ball end 232 may be held in the block 210 using a keeper or retainer plate 220. In one embodiment of the invention, the space for the universal support assembly 200 between the support structure 100 and the tank stiffeners 120 may be about 400 mm. The installation of the universal support assemblies 200 and the support structure 100 may be shimmed.

As the tank experiences thermal expansion and contraction, the link member 230 and the ball ends 231 and 232 will rotate in the support blocks 205 and 210 allowing the tank wall to move relative to the surrounding support structure. When acting together, the universal support assemblies 200 in FIG. 4A will operate to allow substantially in-plane movement by expansion and contraction of a tank wall 22, thereby avoiding the build-up of unacceptable thermal stresses, while providing axial load carrying capability in the link members 230. Because of the ball and socket arrangement of the ball ends 231 and 232, the universal support assemblies 200 allow unrestricted in-plane movement (360 degree in-plane movement) of the tank wall 70. It should be understood that the in-plane movement of the tank wall 22 is accompanied by small movement of the tank wall 22 in the direction orthogonal to the tank wall due to the inherent rotational movement of the link members 230. As will be appreciated by those of skill in the art, the movement orthogonal to the tank wall will be much smaller than any in-plane movement.

In order to maintain the low temperatures of the liquefied gases contained in the tank 20, the supporting blocks 205 and 210 may have a low thermal conductivity in order to reduce heat loss, thereby ensuring that the specified boil-off rate for the containment system may be met. Laminated wood material, such as Lignostone produced by Roechling Haran in Gastonia, N.C., may be used as an insulating block. Other low thermal conductivity materials with good compressive strength, such as a many composite materials, may also be used for the support blocks 205 and 210. The link member 230 may be fabricated from commercially available stainless steel, such as 304L stainless steel, or other such metal. A stainless steel link member 230 may function as a thermal break due to its lower coefficient of thermal conductivity than the aluminum tank material. The fasteners 240 may be made from stainless steel, K-monel, or other suitable high strength fastener material depending upon final strength requirements.

Figures 5A, 5B:
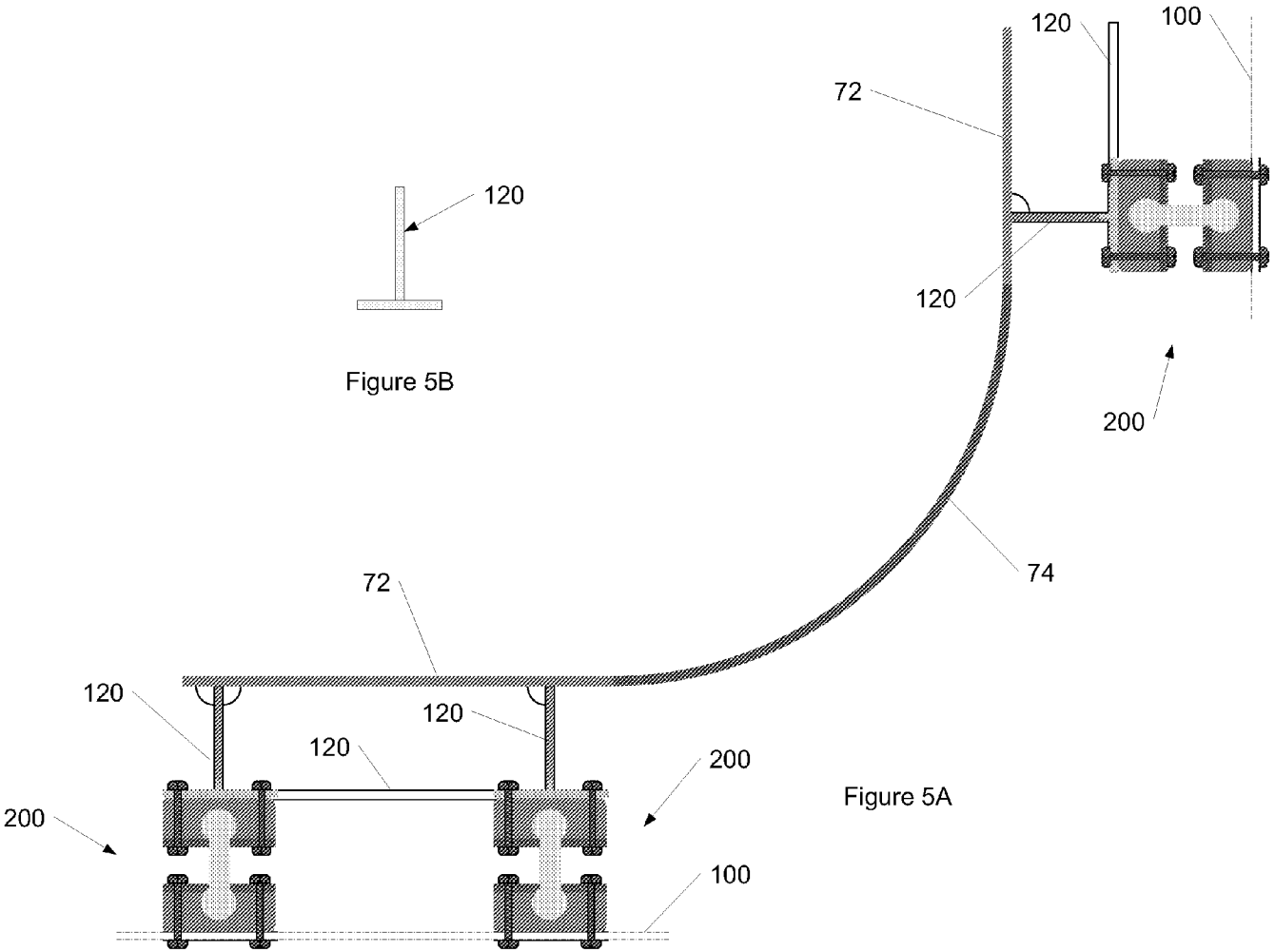
FIG. 5A schematically illustrates a top view of a portion of a semi-membrane tank in accordance with an embodiment of the invention.
FIG. 5B illustrates a cross-section of a stiffener in accordance with an embodiment of the invention.

FIG. 5A schematically illustrates a view of cylindrical vertical corners 74 of the tank 70 with portions of two sidewalls 72. As shown in the figure, the stiffeners 120 are attached to the exterior of the sidewalls 72. FIG. 5B illustrates the "T" shaped cross-section of the stiffeners 120 that form the grid patterns shown in FIGS. 1, 2A, 2B, and 2C.

To illustrate the arrangement of the universal support assemblies around a vertical corner 74, the universal support assemblies attach to the stiffeners 120 at the intersections of the grid pattern. It should be understood that the universal support assemblies 200 may be arranged on alternative patterns or locations. Additionally, the locations and the patterns of the stiffeners 120 may be changed and altered.

FIG. 6 schematically illustrates a plan view of a portion of a wall of the semi-membrane tank 70 and an example of a portion of the insulation that may be applied to the tank 70 and the stiffeners 120. As shown, insulation panels 130 may be installed around the blocks 205 of the universal support assemblies 200, on and between the stiffeners 120. The insulation panels 130 may be configured to cover the walls of the tank 20 in order to reduce the boil-off rate to acceptable levels. The insulation panels 130 cover the entire length of the stiffeners 120 between the universal support assemblies 200. Although not shown in FIG. 6, insulation may be arranged to cover the entire tank 70.

Figure 7:
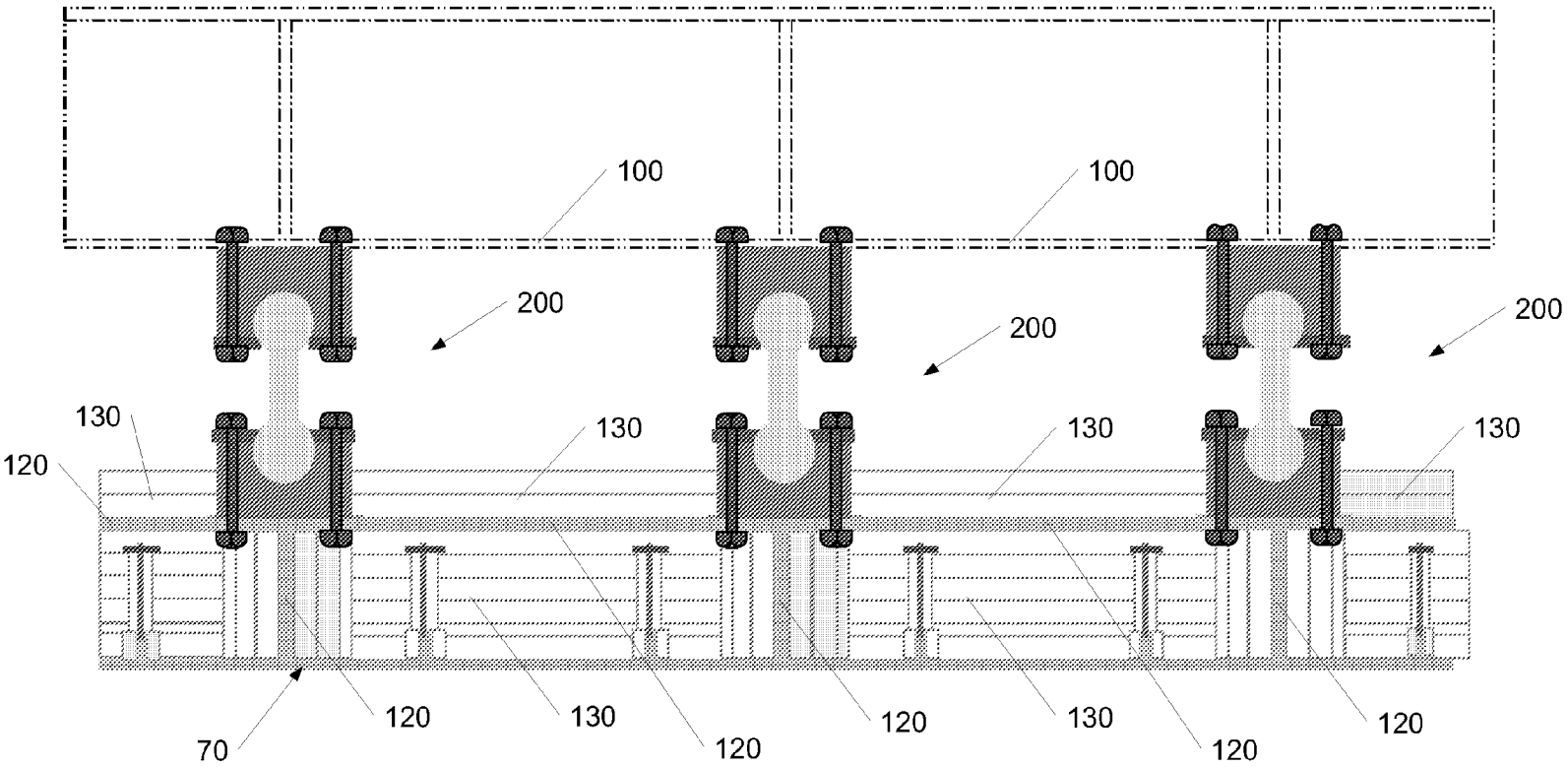
FIG. 7 schematically illustrates a cross-section of a portion of the tank wall with insulation shown in FIG. 6 along line A-A.

FIG. 7 schematically illustrates a cross-section of the portion of the tank wall shown in FIG. 6 along line A-A. The insulation panels 130 are installed on the tank 70, including the placement of insulation panels between and on top of the "T" shaped stiffeners 120. The insulation panels 130 cover the entire length of the stiffeners 120 between the universal support assemblies 200. As shown in FIGS. 6 and 7, no gap around the supporting blocks 205 is required on the tank walls because the blocks 205 and the ball ends 231 do not slide relative to the tank walls. Rather, the ball ends 231 rotate or pivot in a ball and socket configuration without restricting the placement of the insulation panels 130 or requiring a gap in the insulation. The insulation may be fabricated from either polyurethane or poly-isocyanurate foam panels, for example, and may be secured by shot studs to the tank walls.

Figure 9:
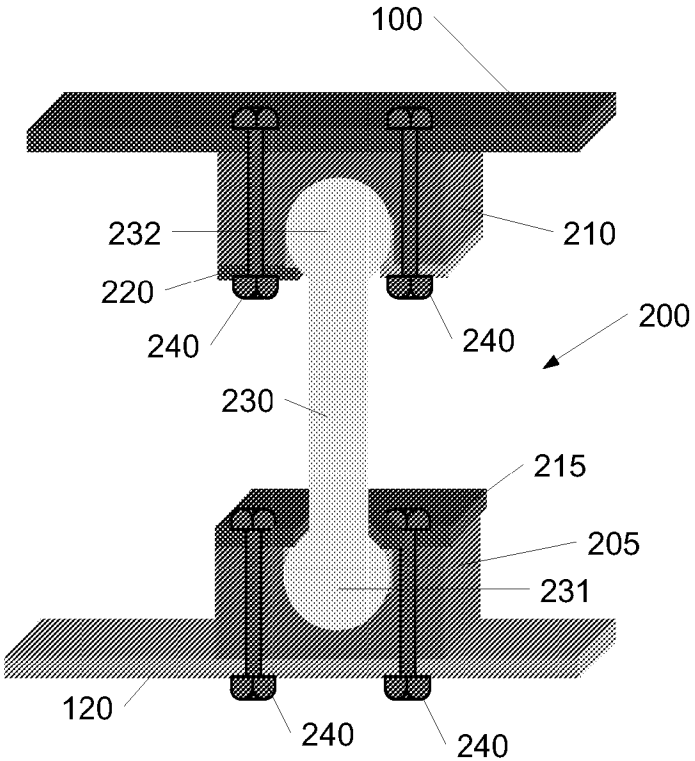
FIG. 9 schematically illustrates a perspective view of the universal support assembly shown in FIG. 8.
Figure 8:
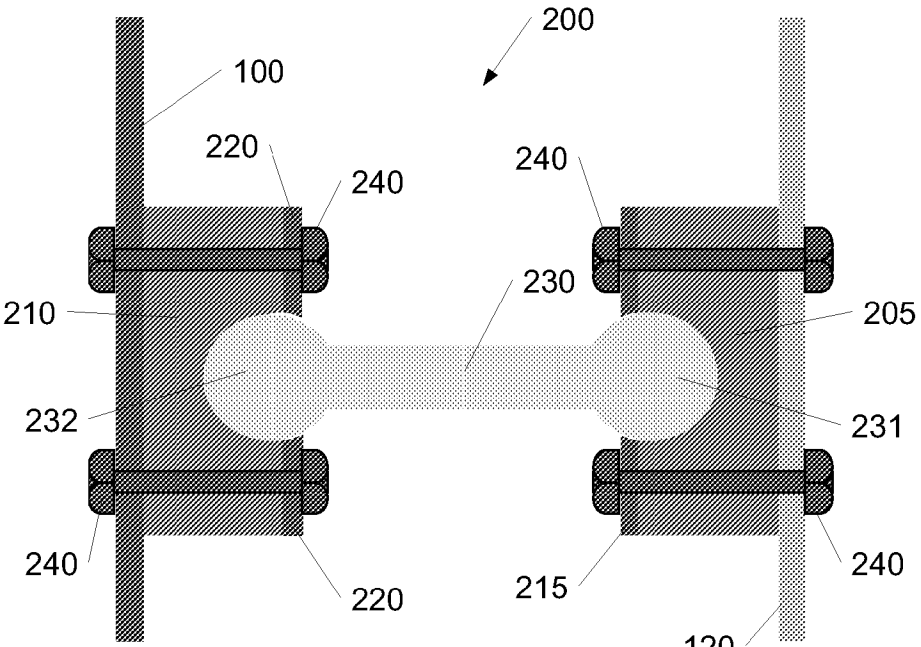
FIG. 8 schematically illustrates a cross-section of a universal support assembly in accordance with an embodiment of the invention.

FIG. 8 schematically illustrates an enlarged view of a cross-section of a universal support assembly 200 in accordance with one embodiment of the invention. Likewise, FIG. 9 schematically illustrates a perspective view of the same cross-section of the universal support assembly 200. The ball and socket configuration formed between the ball ends 231 and 232 and the sockets formed by the combination of the supporting blocks 231 and 232 and the retainer plates 215 and 220 provides for movement in any direction and is not limited to a sliding motion along a groove as previously taught in the prior art. As shown in FIGS. 8 and 9, the opening in the retainer plates 215 and 220 is undersized relative to the diameter of the ball ends 231 and 232. It should be understood that the undersized opening in the retainer plates 215 and 220 may be sized with sufficient clearance to allow the rotation of the link members, thereby accommodating unrestricted expansion and contraction of the tank 20. Because of the limitless range of motion between the link member and the blocks, it is not necessary to install the supporting blocks along radial lines of movement from the center of the tank. Such an arrangement reduces stresses induced in the tank structure and the surrounding supporting structure, reducing material fatigue and increasing usable tank life.

Figure 10:
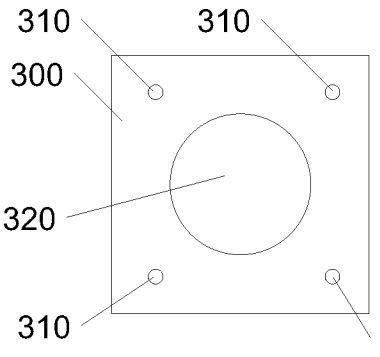
FIG. 10 schematically illustrates a plan view of the top of a supporting block in accordance with an embodiment of the invention.

FIG. 10 schematically illustrates a plan view of the top of a supporting block 300, which represents the support blocks 205 or 210, for example, shown in the other figures. The block 300 includes through holes 310 for receiving the fasteners 240 and securing the retainer plate and the supporting blocks to their respective locations. Additionally, the block 300 includes an opening or hole 320. The block 300 and the hole 320 may be machined out of a block of material or formed as a unitary element. The hole 320 may formed a simple cylindrical shape internal to the block 300 or may have a partial contoured surface at the bottom of the hole to match the shape and surface of the ball ends on the link members 230.

Figure 11:
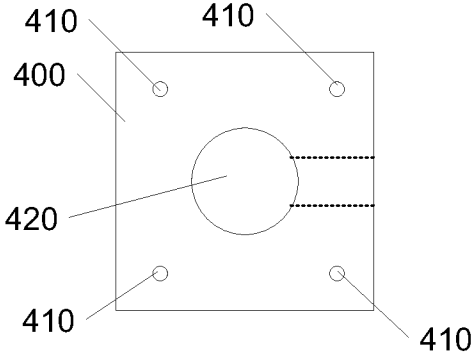
FIG. 11 schematically illustrates a plane view of the top of a retainer plate in accordance with an embodiment of the invention.

FIG. 11 schematically illustrates a plan view of the top of a retainer plate 400, which may represent the retainer plates 215 or 220, for example, shown in the other figures. The retainer plate 400 may include through holes 410 for receiving the fasteners and securing the retainer plates and the supporting blocks to their respective locations. The retainer plate 400 also includes a hole or opening 420, which serves as a retaining mechanism for the ball ends on the link members 230. As shown in FIGS. 8 and 9, the underside of the retainer plates may include beveled edges or a contoured surface around the opening 420. The contoured surfaces around the underside of the opening 420 may be configured to match the shape and size of the ball ends in order to facilitate smooth rotation of the ball end.

Although the size and shape of the ball ends 231 and 232, as well as the holes 320 and 420, may differ depending on the location for installation, the size and shape of the elements may be standardized over large portions of the assembled semi-membrane tank in order to reduce part count and complexity of the installation. Additionally, the universal support assemblies may be assembled by including a slot in the retainer plate 400 (shown in dotted lines) sufficient to allow the center section of the link member to slide into the opening 420. Once the link member 230 is positioned within the opening 420, the retainer plate may be secured to the support block, forming the ball and socket arrangement of the universal support assembly. Alternatively, the ball ends 231 and 232 on the link member 230 may be fabricated as separate pieces and assembled once the retainer plates have been placed onto the link members 230.

Figure 12:
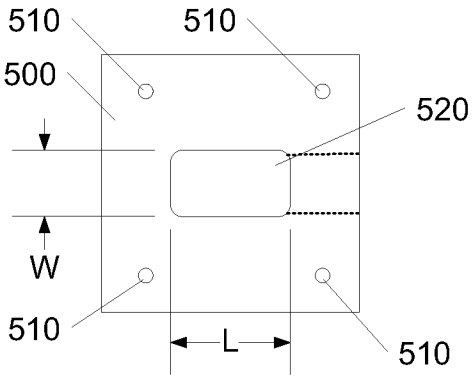
FIG. 12 schematically illustrates a plane view of the top of another retainer plate in accordance with an embodiment of the invention.

Additionally, it is contemplated that the ball and socket configuration discussed above may be easily modified for use as an anchored support assembly or an assembly configured to allow relative motion in only one direction, such as the support assemblies 46 in FIG. 1 and support assemblies 66 and 68 in FIG. 2. FIG. 12 schematically illustrates a plan view of the top of a retainer plate 500 for use in an anchor support assembly. It is contemplated that the retainer plates on a universal support assembly 200 may include the retainer plate 500 shown in FIG. 12 mounted on the support block 300 shown in FIG. 10. The retainer plate 500 may represent the retainer plates 215 or 220, for example, shown in the other figures to create a support assembly that allows relative motion in only one direction. Generally, the retainer plate 500 may include through holes 510 for receiving the fasteners and securing the retainer plates and the supporting blocks to their respective locations. However, the retainer plate 500 may include a rectangular opening 520, which serves as a retaining mechanism for the ball ends on the link members 230 and serves as a guide to the center section of the link member 230. By sizing the slot opening 520 such that the width (W) of the rectangular opening 520 is approximately the diameter or width of the center section of the link member 230, the rectangular opening 520 may be configured to allow movement in only one direction, in the direction of the length (L) of the rectangular opening 520. The size and shape of the rectangular opening 520 may be changed depending on the desired amount of possible movement. By placing the a retainer plate 500 on one or more of the plates 215 or 220 shown in FIG. 8 or 9, the support assembly 200 may be configured as a unidirectional support assembly as discussed with respect to support assemblies 46, 66, and 68 in FIGS. 1 and 2. It should be understood that the retainer plate 500 may be used with link members having spherical ends.

Figure 13:
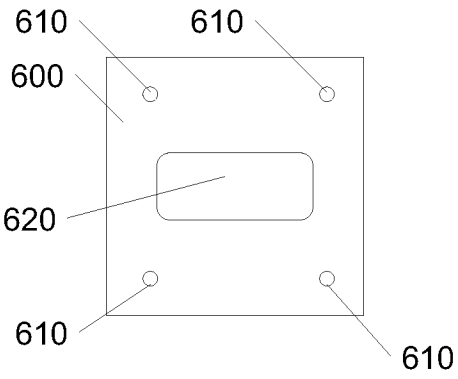
FIG. 13 schematically illustrates a plane view of the top of another supporting block in accordance with an embodiment of the invention.
Figure 14:
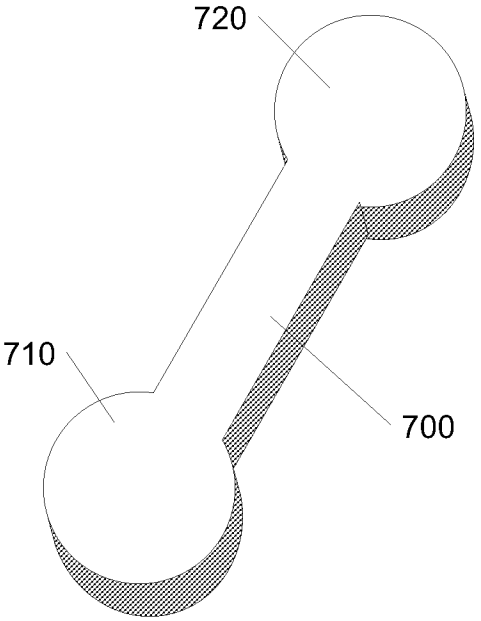
FIG. 14 schematically illustrates a perspective view of a link member in accordance with an embodiment of the invention.

As an alternative, a support assembly may be configured to allow relative movement in only one direction by assembling a support assembly from a support block having a slotted opening and a link member having rounded flat ends configured to slide into the slotted opening. FIG. 13 schematically illustrates a plan view of the top of a support block 600 configured for use in a unidirectional support assembly. As with the support block 300, the support block 600 may include through holes 610 for receiving the fasteners and securing the retainer plates and the supporting blocks to their respective locations. FIG. 14 schematically illustrates a perspective view of an example of a link member 700 configured to be used with the support block 600 shown in FIG. 13. The rounded and flat ends 710 and 720 of the link member 700 may be inserted into the rectangular opening 620. Due to the rounded nature of the ends 710 and 720, the link member 700 may rotate in only one direction. It should be understood that the support block 600 and the link member 700 may be used with either the retainer plate 400 or the retainer plate 500. Although both ends of the link member 700 are configured to rotate only about a single axis, it should be understood that a support assembly may be configured with one end configured to support universal rotation (using retainer plate 400, for example) and the other end of the link member configured to rotate substantially about only one axis (using retainer plate 500, for example).

It should be understood that the support assemblies disclosed herein may be used with other tank arrangements and may be alternatively configured on the semi-membrane tank. Likewise, the size, number, and positioning of the support assemblies may be changed. It should also be understood that the semi-membrane tank and surrounding structures may be assembled using various methods. As discussed above, embodiments of the present invention may be employed on ships or floating structures or on other land-based structures capable of holding or transporting liquefied gases, such as LNG.

The embodiments described herein are examples of implementations of the invention. Modifications may be made to these examples without departing from the scope of the invention, which is defined by the claims, below.

What is claimed is:

1. A tank assembly comprising:

a tank comprising a wall having an external surface;

a first support block coupled to the external surface of the wall, the first support block having a first socket formed therein;

a support structure for the wall;

a second support block coupled to the support structure, the second support block having a second socket formed therein;

a link member having a first end received by the first socket and having a second end received by the second socket;

a first plate having a first hole extending through the first plate, wherein the link member passes through the first hole such that the first end of the link member fits into the first socket of the first support block, and wherein the first plate is coupled to the first support block to retain the first end of the link member in the first socket; and a second plate having a second hole extending through the second plate, wherein the link member passes through the second hole such that the second end of the link member fits into the second socket of the second support block, and wherein the second plate is coupled to the second support block to retain the second end of the link member in the second socket.

2. The tank assembly of claim 1, wherein the first end of the link member and the first socket form, at least in part, a first ball and socket joint.

3. The tank assembly of claim 2, wherein the second end of the link member and the second socket form, at least in part, a second ball and socket joint.

4. The tank assembly of claim 1, wherein the link member, the first support block, and the second support block are configured to allow the wall to move rotationally relative to the support structure.

5. The tank assembly of claim 1, further comprising a stiffening member coupling the first support block to the wall.

6. The tank assembly of claim 1, wherein:

the first plate is parallel to the wall; and the first plate has a contoured surface around the first hole configured to match a shape and a size of the first end of the link member to retain the first end of the link member in the first socket.

7. The tank assembly of claim 1, wherein the link member, the first support block, and the second support block are configured to allow 360 degree in-plane movement of the tank relative to the support structure.

8. The tank assembly of claim 1, wherein:

the link member is rotationally coupled to the wall by the first support block and the first plate; and the link member is rotationally coupled to the support structure by the second support block and the second plate.

9. A support arrangement for coupling a tank to a surrounding support structure, the tank having a tank wall, the support arrangement comprising:

a first support block for the tank wall, the first support block having a first socket formed therein;

a second support block for the support structure, the second support block having a second socket formed therein;

a link member having a first end configured to fit within the first socket and having a second end configured to fit within the second socket;

a first plate having a first hole extending through the first plate and configured to allow the link member to pass therethrough, the first plate coupled to the first support block to retain the first end of the link member in the first socket; and a second plate having a second hole extending through the second plate and configured to allow the link member to pass therethrough, the second plate coupled to the second support block to retain the second end of the link member in the second socket;

wherein the link member, the first socket, and the second socket form two ball and socket joints to allow in-plane movement of the tank wall relative to the support structure.

10. The support arrangement of claim 9, wherein:

the first plate is parallel to the tank wall when the first support block is coupled to the tank wall; and the first plate has a contoured surface around the first hole configured to match a shape and a size of the first end of the link member to retain the first end of the link member in the first socket.

11. The support arrangement of claim 9, wherein:

the first end of the link member and the first socket form a first ball and socket joint; and the second end of the link member and the second socket form a second ball and socket joint.

12. The support arrangement of claim 9, wherein the link member, the first support block, and the second support block are configured to allow unrestricted in-plane movement of the tank relative to the support structure.

13. The support arrangement of claim 9, wherein:

the link member is rotationally coupled to the wall by the first support block and the first plate; and the link member is rotationally coupled to the support structure by the second support block and the second plate.

14. An assembly comprising:

a tank having a tank wall;

a grid of stiffener members attached to an exterior of the tank wall;

a plurality of first support blocks supported by the grid of stiffener members, each of the plurality of first support blocks having a respective first socket formed therein;

a support structure external to the tank;

a plurality of second support blocks coupled to the support structure, each of the plurality of second support blocks having a respective second socket formed therein; and a plurality of link members coupling the tank to the support structure, each of the plurality of link members having a first end retained within a respective one of the first sockets, and having a second end retained within a respective one of the second sockets;

wherein the plurality of first support blocks, the plurality of second support blocks, and the plurality of link members cooperate to provide universal support assemblies and anchor support assemblies for the tank wall;

wherein each of the universal support assemblies is configured to allow 360 degree in-plane movement of the tank wall relative to the support structure; and wherein each of the anchor support assemblies is configured to allow in-plane movement of the tank wall relative to the support structure in only one direction.

15. The assembly of claim 14, wherein the first end of each link member and the respective one of the first sockets form a respective ball and socket joint.

16. The assembly of claim 14, wherein the second end of each link member and the respective one of the second sockets form a respective ball and socket joint.

17. The assembly of claim 14, further comprising:

a plurality of first retaining plates coupled to the plurality of first support blocks to retain the second ends of the plurality of link members within the second sockets; and a plurality of second retaining plates coupled to the plurality of second support blocks to retain the first ends of the plurality of link members within the first sockets.

18. The assembly of claim 17, wherein:

each of the plurality of link members is rotationally coupled to the tank wall by a respective one of the plurality of first support blocks and by a respective one of the plurality of first retaining plates.

19. The assembly of claim 17, wherein:

each of the plurality of link members is rotationally coupled to the support structure by a respective one of the plurality of second support blocks and by a respective one of the plurality of second retaining plates.

* * * * *